US011177063B2

(12) United States Patent
Heinrich et al.

(10) Patent No.: US 11,177,063 B2
(45) Date of Patent: Nov. 16, 2021

(54) METHOD FOR MAGNETISING AT LEAST TWO MAGNETS HAVING DIFFERENT MAGNETIC COERCIVITY

(71) Applicant: Phoenix Contact GmbH & Co. KG, Blomberg (DE)

(72) Inventors: Jens Heinrich, Falkensee (DE); Ralf Hoffmann, Berlin (DE); Christian Mueller, Berlin (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 95 days.

(21) Appl. No.: 16/638,092

(22) PCT Filed: Aug. 10, 2018

(86) PCT No.: PCT/EP2018/071813
§ 371 (c)(1),
(2) Date: Feb. 10, 2020

(87) PCT Pub. No.: WO2019/030399
PCT Pub. Date: Feb. 14, 2019

(65) Prior Publication Data

US 2020/0211747 A1 Jul. 2, 2020

(30) Foreign Application Priority Data

Aug. 11, 2017 (BE) ..... 2017/5552

(51) Int. Cl.
*H01F 13/00* (2006.01)

(52) U.S. Cl.
CPC ..... *H01F 13/003* (2013.01)

(58) Field of Classification Search
CPC ..... H01F 13/003
See application file for complete search history.

(56) References Cited

U.S. PATENT DOCUMENTS 4,160,965 A 7/1979 Kobler et al.
4,703,293 A 10/1987 Ono et al.
(Continued)

FOREIGN PATENT DOCUMENTS

CN 102576477 A 7/2012
DE 1564315 6/1969
(Continued)

OTHER PUBLICATIONS

IP.com Search Results.*
(Continued)

*Primary Examiner* — Mohamad A Musleh
(74) *Attorney, Agent, or Firm* — Kaplan Breyer Schwarz, LLP

(57) ABSTRACT

A method for magnetizing at least two magnets having different magnetic coercivities, includes the steps of:

a) simultaneously exposing the at least two magnets to a first substantially homogeneous magnetic field having a predeterminable first field strength and a first magnetic field direction for completely magnetizing the magnets in the first magnetic field direction;

b) simultaneously exposing the magnets magnetized in step a) to a second substantially homogeneous magnetic field having a predeterminable second field strength and a second magnetic field direction opposite to the first magnetic field direction such that the at least two magnets are differently magnetized.

11 Claims, 8 Drawing Sheets

(56) References Cited

U.S. PATENT DOCUMENTS

| | | | | |
|---|---|---|---|---|
| 6,670,871 | B1 | 12/2003 | Saso et al. | |
| 8,544,630 | B2 * | 10/2013 | Schutzmann | G07D 7/04 194/302 |
| 8,910,869 | B2 * | 12/2014 | Schutzmann | G06K 7/087 235/450 |
| 9,183,421 | B2 * | 11/2015 | Paul | G07D 7/04 |
| 10,002,267 | B2 * | 6/2018 | Schutzmann | G07D 7/04 |
| 10,121,581 | B2 * | 11/2018 | Zhu | H01F 13/003 |
| 10,605,774 | B2 * | 3/2020 | DiFonzo | G01N 27/72 |
| 2015/0091680 | A1 * | 4/2015 | Gery | H01F 13/003 335/284 |
| 2015/0228392 | A1 | 8/2015 | Lombardo et al. | |
| 2016/0071350 | A1 | 3/2016 | Naoki | |

FOREIGN PATENT DOCUMENTS

| | | | |
|---|---|---|---|
| DE | 2148377 | A | 4/1973 |
| DE | 3528090 | C1 | 10/1986 |
| DE | 3826624 | A1 | 3/1989 |
| DE | 10251566 | A1 | 5/2004 |
| JP | 57-202712 | A | 12/1982 |
| JP | 62-093916 | A | 4/1987 |
| JP | 04-087308 | A | 3/1992 |
| JP | 2016-219465 | A | 12/2016 |
| WO | 2013/144232 | A1 | 10/2013 |
| WO | 2014/147824 | A1 | 9/2014 |

OTHER PUBLICATIONS

Global Dossier Search.*

Office Action (and English Translation of Office Action) dated Nov. 30, 2020 in German Patent Application No. 18 749 830.8.

Authorized Officer: Nora Lindner, English translation of the International Report on Patentability issued in corresponding PCT application No. PCT/EP2018/071813, dated Feb. 11, 2020, 8 pp.

Office Action issued in counterpart Chinese patent application No. 201880051865.7, Feb. 20, 2021, 10 pp. w/ translation.

Office Action issued in counterpart Japanese patent application No. 2020-504372, dated Feb. 10, 2021, 7 pp.

Office Action dated May 11, 2018 in German Patent Application No. 102017118409.0.

Search Report issued in Belgian Patent Application BE2017/5552 dated May 3, 2018.

Authorized Officer: Rouzier, Brice, International Search Report and Written Opinion issued in counterpad PCT application No. PCT/EP2018/071813, dated Sep. 19, 2018, 11 pp.

* cited by examiner

METHOD FOR MAGNETISING AT LEAST TWO MAGNETS HAVING DIFFERENT MAGNETIC COERCIVITY

FIELD

The invention relates to a method for magnetizing at least two magnets having different magnetic coercivities.

BACKGROUND

Polarized electromagnetic relays are known which may each have a magnet system comprising a coil, a magnetic core and two permanent magnets. Such a polarized electromagnetic relay is known for example from WO 2013/144232 A1.

The problem addressed by the present invention is to provide a method with which at least two magnets can be differently magnetized in a simple, rapid, flexible and cost-effective manner.

A key concept of the invention can be considered that of exposing at least two magnets having different magnetic coercivities simultaneously to a first magnetic field and then simultaneously to a second magnetic field which have opposite magnetic field directions, such that the two magnets have different magnetizations at the end of the magnetization process. For this purpose, the magnets are preferably arranged together in a magnetization device, which for example comprises a magnetization coil, before they are magnetized according to the invention.

The magnets magnetized in this way can be used in particular as permanent magnets in an electromagnetic relay. It should be noted that the at least two magnets can initially be unmagnetized or premagnetized as desired before they are exposed to the first magnetic field.

The above-mentioned technical problem is solved by the method steps in claim 1.

SUMMARY

Accordingly, a method for magnetizing at least two magnets having different magnetic coercivities is provided, which method comprises the following method steps:

a) simultaneously exposing the at least two magnets to a first substantially homogeneous magnetic field having a predeterminable first field strength and a first magnetic field direction for completely magnetizing the magnets in the first magnetic field direction;

b) simultaneously exposing the magnets magnetized in step a) to a second substantially homogeneous magnetic field having a predeterminable second field strength and a second magnetic field direction opposite to the first magnetic field direction such that the at least two magnets are differently magnetized, the first field strength being higher than the second field strength.

If exactly two magnets are magnetized in this way, they can be considered to be an assembly having the properties of a three-pole magnet.

It should be noted that the at least two magnets can initially be unmagnetized or premagnetized before they are exposed to the first and then the second magnetic field. The premagnetization can take place in a predetermined manner or in any manner. In other words, the level of the premagnetization can be predetermined or can be selected as desired.

The term "completely magnetize" can be understood to mean that the magnets are magnetized to magnetic saturation.

Expediently, before carrying out steps a) and b), the at least two magnets are arranged in a magnetization device, the first and second magnetic fields being provided by the magnetization device. The first and second homogeneous magnetic fields are preferably generated in an interior of the magnetization device in which the magnets are arranged.

The magnetization device may comprise a magnetization coil, a device electrically connected to the magnetization coil for generating an adjustable excitation current, in particular a pulse magnetization device, and optionally a carrier assembly for receiving and retaining the magnets.

In relation to the first and second magnetic field directions, the magnets are arranged one behind the other, such that the magnets are magnetized axially or in the field direction.

In an advantageous manner, in step b), the predeterminable second field strength of the second magnetic field can be set such that the at least two magnets are magnetized in opposite directions, the magnet having the higher magnetic coercivity being magnetized in the first magnetic field direction and the magnet having the lower coercivity being magnetized in the second magnetic field direction.

BRIEF DESCRIPTION OF THE DRAWINGS

The invention is explained in greater detail in the following on the basis of an embodiment, in which.

DETAILED DESCRIPTION

Figure 2:
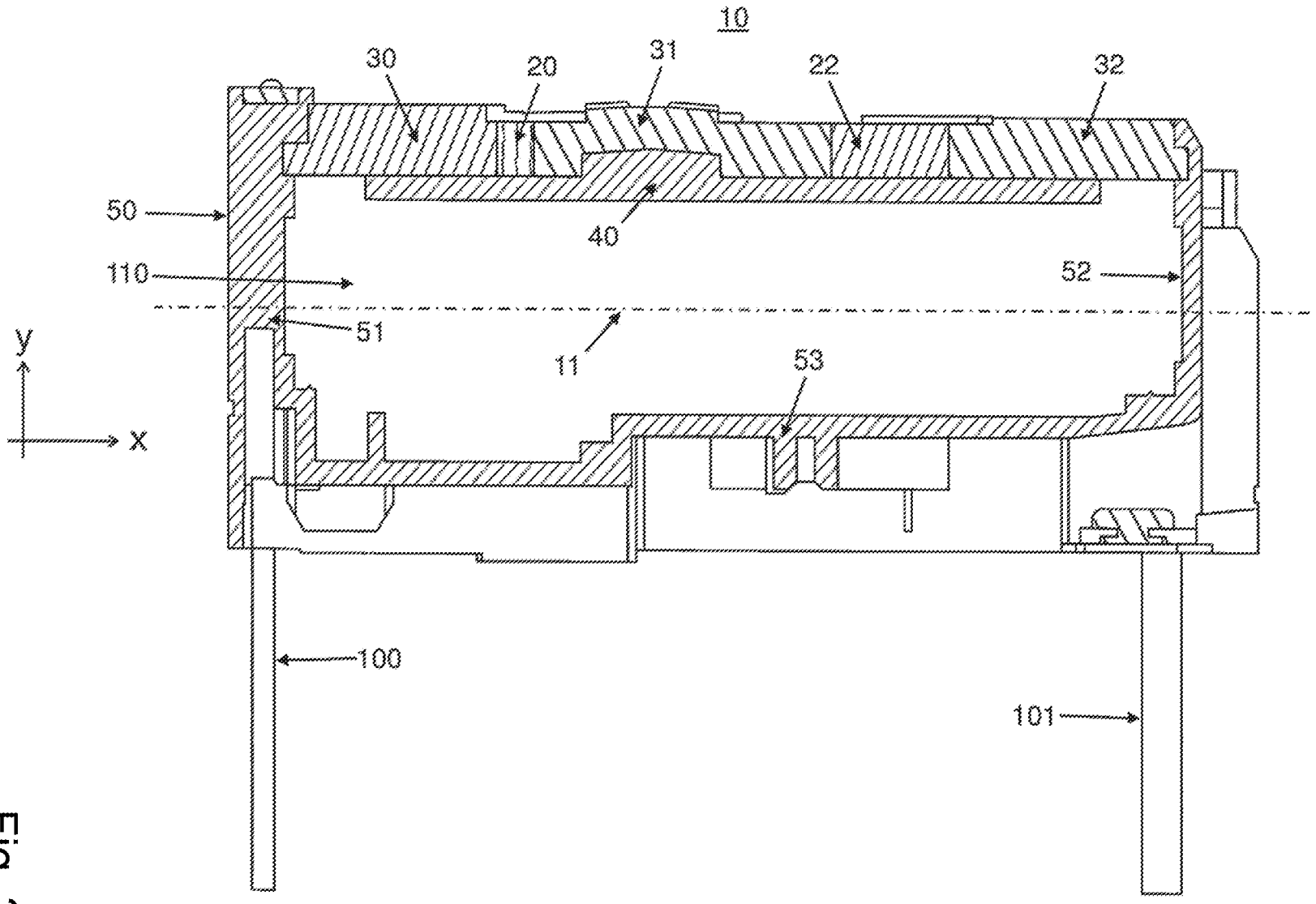
FIG. 2 is a longitudinal section through the assembly arranged in the polarized relay and containing the two magnets.

FIG. 2 shows an example of two magnets 20 and 22 having different magnetic coercivities, which may for example be parts of an assembly 10. The magnets 20 and 22 may for example be unmagnetized or premagnetized as desired and may each be made of a ferromagnetic material. For example, it is assumed that the magnet 20 has a higher magnetic coercivity than the magnet 22. For example, the magnet 20 having a higher magnetic coercivity is an SmCo magnet, while the magnet 22 having a lower magnetic coercivity may be a ferrite magnet. Of course, more than two magnets may also be used.

The assembly 10 preferably has a carrier component 50, which may have a U-shaped cross section. In this case, the carrier component 50 has two opposite wall portions 51 and 52 and a base portion 53 connecting the two wall portions. Although the two magnets 20 and 22 can be arranged immediately next to one another, in the example shown they are arranged between magnetic flux parts 30, 31 and 32 and thus are spatially separated from one another.

As also shown in FIG. 2, the two magnets 20 and 22 are arranged in parallel with a longitudinal axis 11 of the assembly 10 extending in the x direction and one behind the other relative to the longitudinal axis 11.

The magnetic flux part 31 forms a bearing piece for a rocker armature (not shown), while the two magnetic flux parts 30 and 32 form the poles of an electromagnet. The magnetic flux parts 30, 31 and 32 and the two magnets 20 and 22 are supported by a support plate 40. The magnetic flux parts 30 to 32, the magnets 20 and 22 and the support plate 40 are arranged above the base portion 53 between the two wall portions 51 and 52 and enclose a receiving region 110 together with the carrier component 50, in which components of a magnet system can be arranged, as is shown by way of example in FIG. 1 using a polarized electromagnetic relay. The magnet system shown by way of example in FIG. 1 has, inter alia, a rocker armature 12, a ferromagnetic core 2, a coil, and pole shoes 3. The two magnets 20 and 22 can likewise be assigned to the magnet system.

Figure 1:
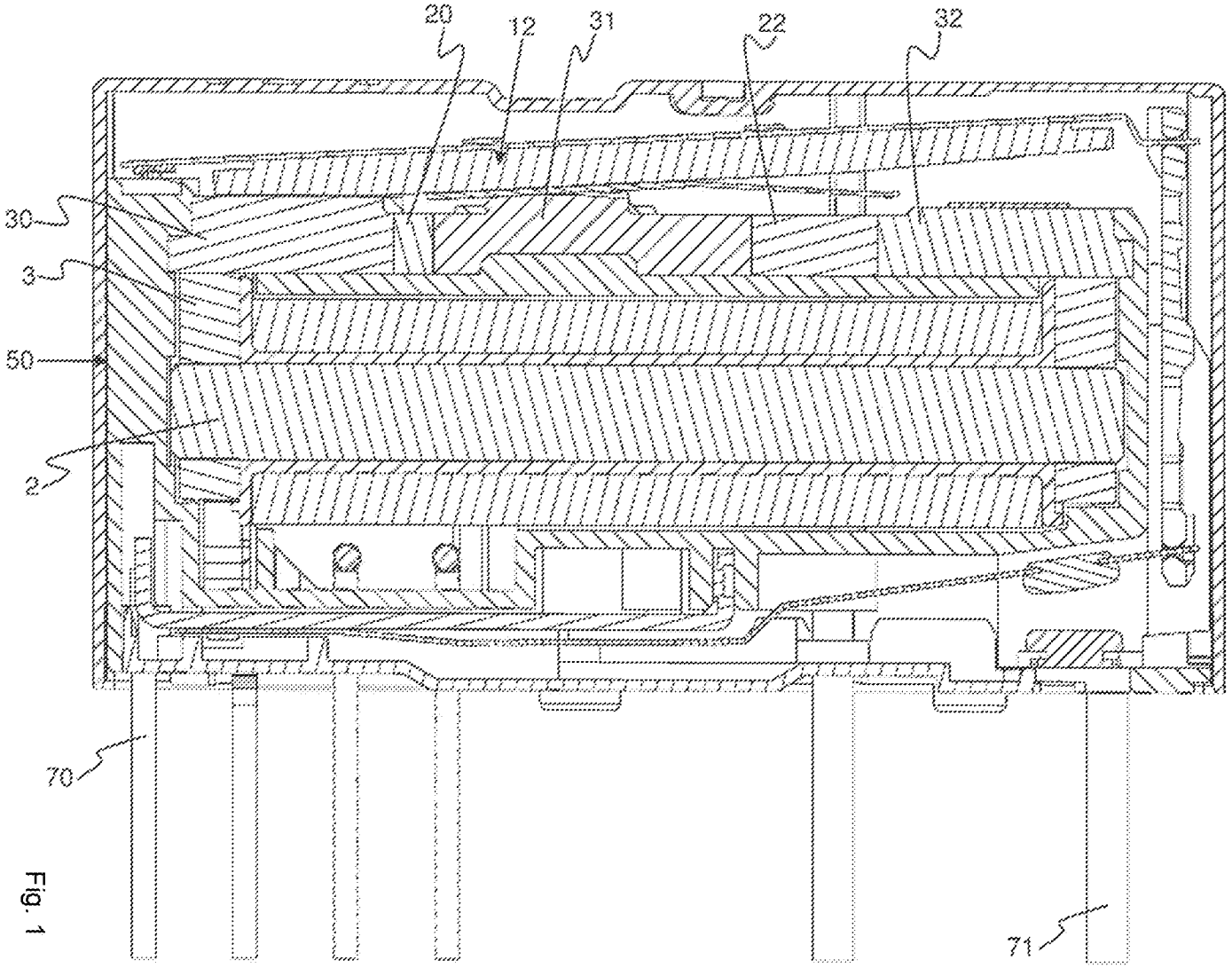
FIG. 1 is a longitudinal section through a polarized electromagnetic relay comprising two magnets magnetized differently according to the invention.

Two connection pins 100 and 101 protrude from the carrier component 50, the connection pin 71 acting, for example, as a load connection pin and the connection pin 70 being provided for electrical connection to a fixed contact of a polarized electromagnetic relay shown by way of example in FIG. 1. The polarized relay shown in FIG. 1 is described in detail in WO 2013/144232 A1, the content of which is hereby incorporated in full.

Before the assembly 10 comprising the two magnets 20 and 22 is inserted into the polarized electromagnetic relay shown in FIG. 1, for example, the two magnets 20 and 22, which have different magnetic coercivities and may initially be unmagnetized or premagnetized as desired, are magnetized in a predefinable two-stage manner. In practice, the magnets are premagnetized for improved transport.

Figure 3A:
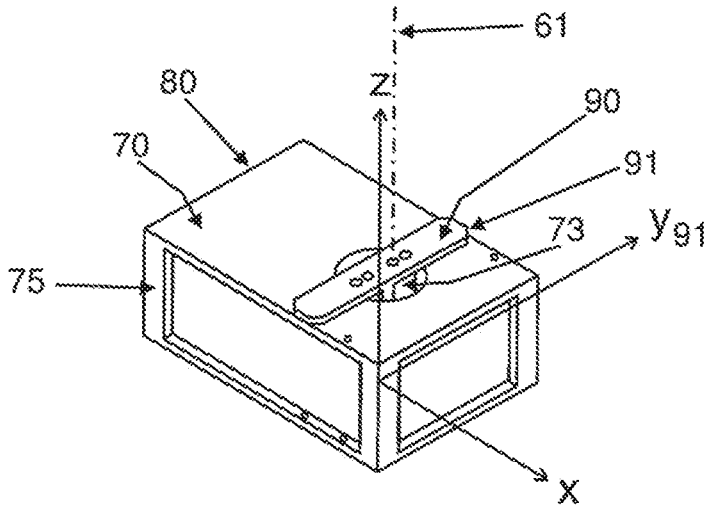
FIG. 3*a* is a perspective view of a magnetization device comprising a carrier assembly, in which the assembly shown in FIG. 2 can be arranged.
Figure 3B:
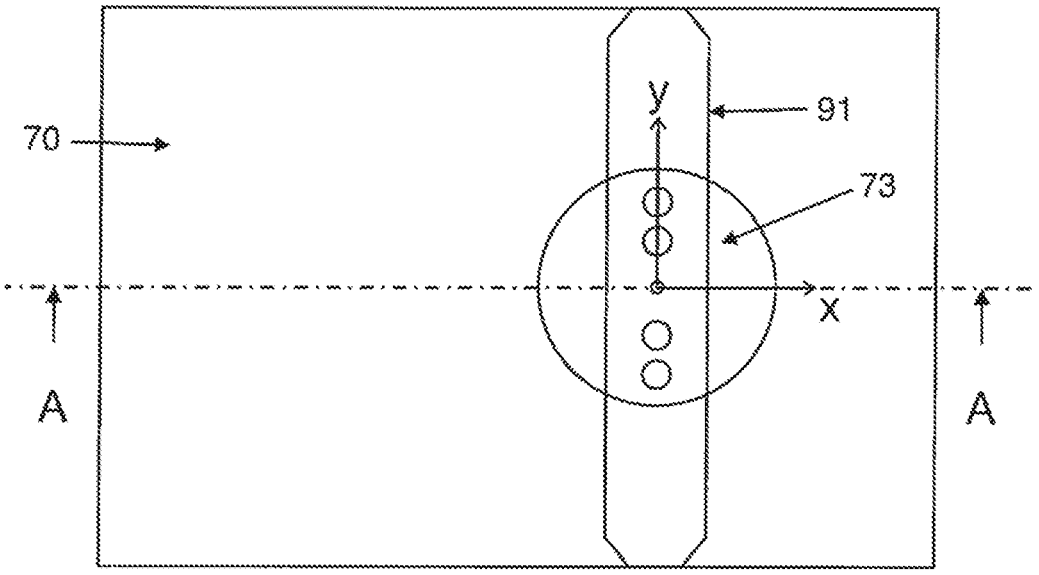
FIG. 3*b* is a plan view of the magnetization device shown in FIG. 3*a*.
Figure 3C:
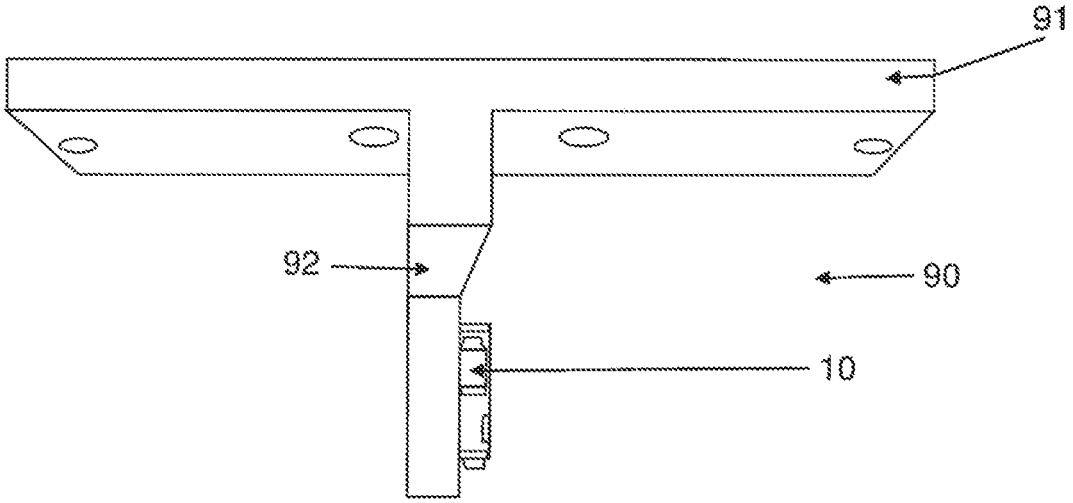
FIG. 3*c* is a perspective view of the mounting device shown in FIG. 3*a*, which is inserted into the carrier assembly.
Figure 3D:
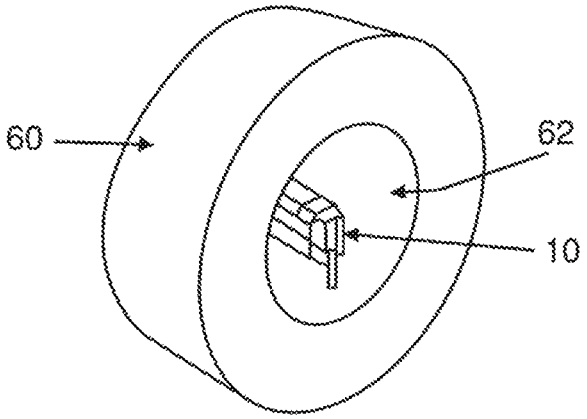
FIG. 3*d* shows a magnetization coil contained in the carrier assembly.

The entire assembly 10 is preferably first arranged in a magnetization device 80, as shown by way of example in FIG. 3*a* in conjunction with FIG. 3*d*. The magnetization device 80 may comprise a magnetization coil 60 as shown in FIG. 3*d* by way of example, to which an adjustable current source (not shown) can be connected to provide the required excitation currents. The current source can be part of a pulse magnetization device, which is designed to generate pulse-like currents. The pulse magnetization device can be assigned to the magnetization device 80. The magnetization coil 60 is preferably designed as an air coil, which has a cylindrical coil interior 62 into which the assembly 10 can be inserted and positioned, as shown in FIG. 3*d*.

As shown in FIG. 3*a*, the magnetization device 80 can further comprise a carrier assembly 70, which contains a housing 75 having an opening 73, the longitudinal axis of which extends in the z direction. The magnetization coil 60 shown in FIG. 3*d* is arranged in the housing 75 such that the opening 73 is flush with the coil interior 62. In the assembled state, the coil axis 61 extends in the z direction and coincides with the longitudinal axis of the opening 73 in the housing 75. The carrier assembly 70 may comprise a mounting device or retaining device 90 which can be detachably fastened to the housing 75 and is designed to retain and position the magnets 20 and 22 or to retain and position the assembly 10 within the magnetizing coil 60. The mounting device 90 may, as shown in FIG. 3, be T-shaped and have a horizontally extending portion 91 and a retaining portion 92 that is perpendicular thereto, which, in the mounted state, extends into the opening 73 or the coil interior 62 in the z direction and to which the assembly 10 is attached. The horizontal portion 91 has a length that is greater than the diameter of the opening 73 in the housing 75. In the mounted state, the mounting device 90 can be detachably screwed to the housing 75 by means of the horizontal portion 91, for example. In this way, the mounting device 90 and thus the assembly 10 can be precisely positioned and fixed in the coil interior 62. This mounting state is also shown in FIG. 3*a* in conjunction with FIG. 3*d*, and in FIG. 3*a* the magnetizing coil 60 is covered by the housing 75.

Advantageously, the magnetization coil 60 arranged in the housing 75 completely encloses the inserted assembly 10 and thus the two magnets 20 and 22 in the mounted state, as shown in FIG. 3*d*. The assembly 10 is arranged within the magnetization coil 60 such that the longitudinal axis 11 of the assembly 10 extends in parallel with the longitudinal axis 61 of the magnetization coil 60 extending in the z direction and that the two magnets 20 and 22 are advantageously arranged on the longitudinal axis of the interior 62 of the magnetization coil 60, i.e. in the center of the interior 62. In this way, the two magnets 20 and 22 are arranged one behind the other in the magnetizing coil 60 relative to the longitudinal axis 61.

It should be noted at this point that the current source (not shown) can provide a first adjustable excitation current which can produce a first substantially homogeneous magnetic field having a predeterminable field strength in the interior 62 of the magnetizing coil 60, which magnetic field has a first magnetic field direction pointing in the positive z direction. The current source can also provide a second adjustable excitation current which can produce a second substantially homogeneous magnetic field having a predeterminable field strength in the interior 62 of the magnetizing coil 60, which magnetic field has a second magnetic field direction pointing in the negative z direction.

It should be noted at this point that the field strength of the first magnetic field is greater than the field strength of the second magnetic field. Furthermore, it should be noted that the first excitation current may be 1000 to 5000 A, for example, while the second excitation current is set to 200 A, for example.

The method for differently magnetizing the magnets 20 and 22 will now be explained in more detail on the basis of a plurality of embodiments in conjunction with FIGS. 4 to 7.

It is assumed that the assembly 10 having the two magnets 20 and 22, which can be unmagnetized or premagnetized as desired, is arranged in the carrier assembly 80 and thus in the magnetization coil 60, as shown by way of example in FIGS. 3*a* to 3*c*.

Figure 4:
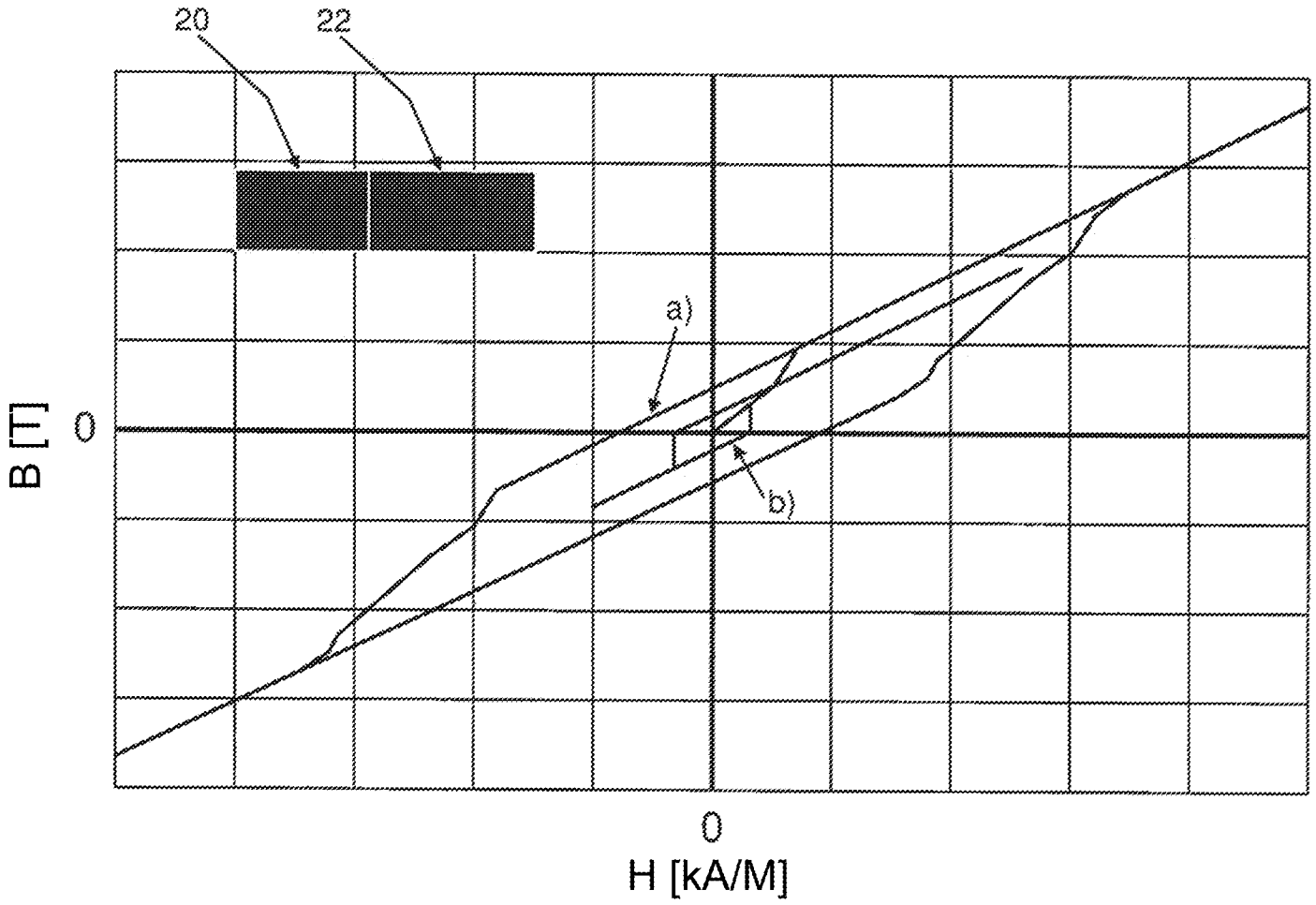
FIG. 4 shows the magnetization curves of the two magnets shown in FIGS. 1 and 2 having different coercivities.

FIG. 4 is first discussed, in which two different magnetization curves a) and b), also called hysteresis curves, are shown by way of example before the first magnetization of the magnets 20 and 22, the magnetization curve a) belonging to the magnet 20 having higher magnetic coercivity, while the magnetization curve b) is assigned to the magnet 22 having lower coercivity. As is known, a magnetization curve graphically represents the dependency of the field line density B on the magnetic field strength H. In addition, in FIG. 4 and also in FIGS. 5 to 7, in a manner known per se, the magnetic field strength H is plotted on the x axis and the flux density B is plotted on the y axis. Furthermore, the two magnets 20 and 22, which are still unmagnetized or are premagnetized as desired, are shown schematically in FIG. 4 such that they are immediately next to one another, although, as shown in FIG. 2, they can also be spaced apart from another by the magnetic flux part 31. However, this is irrelevant to the functioning of the method.

Figure 5:
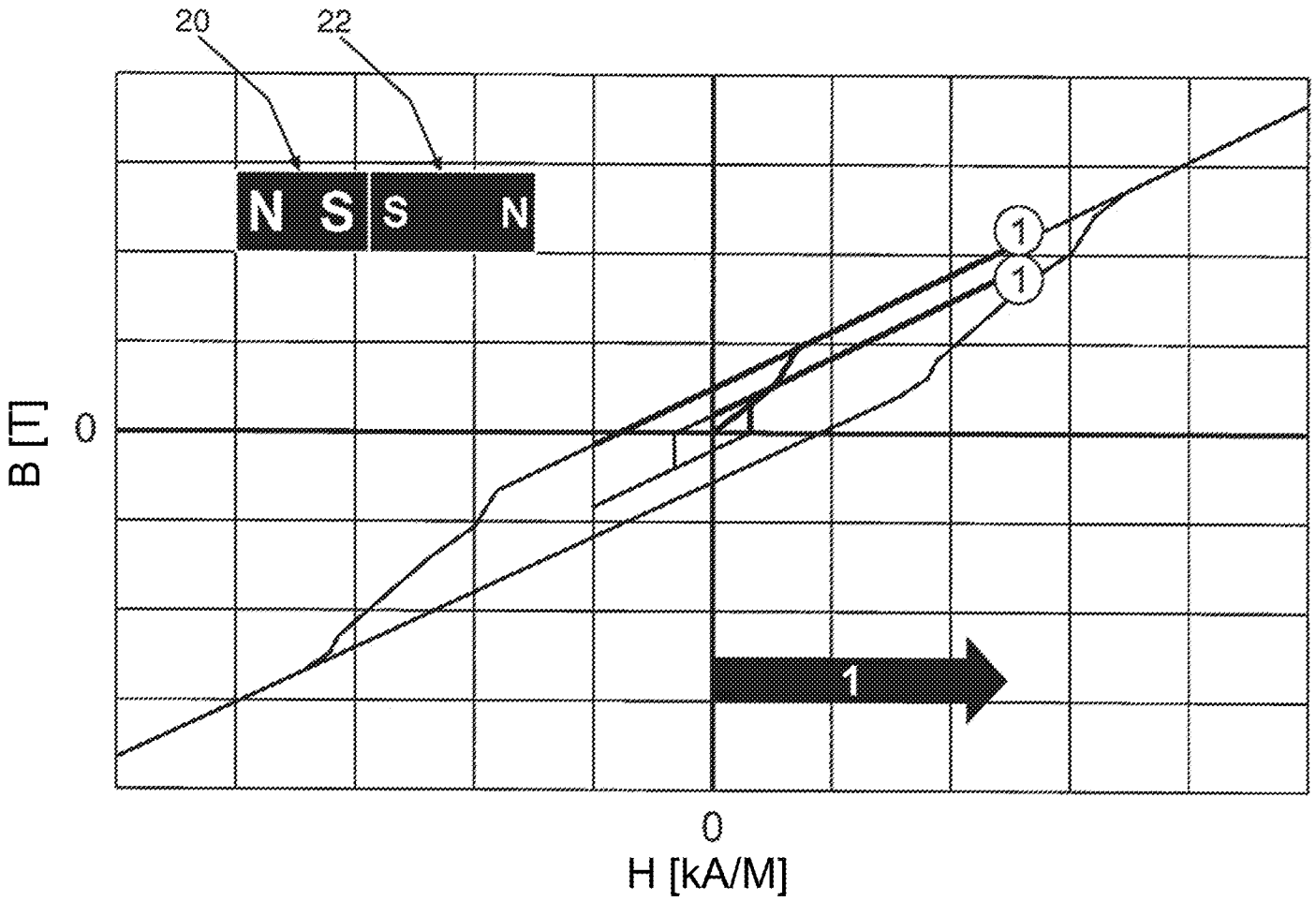
FIG. 5 shows the magnetization of the two magnets having a first magnetic field in the first magnetic field direction on the basis of the magnetization curves shown in FIG. 4.

FIG. 5 will now be considered. It is assumed that a predeterminable first excitation current is fed into the magnetization coil 60 in a first direction, which causes a first substantially homogeneous magnetic field having a predeterminable field strength in a first magnetic field direction, for example in the positive z direction, in the interior 62 of the magnetization coil 60, as symbolized by the arrow pointing to the right. In this way, the two magnets 20 and 22 are simultaneously exposed to the first magnetic field for complete magnetization in the first direction. The magnetization state of the two magnets 20 and 22 after the first magnetization is shown in FIG. 5. Both magnets 20 and 22 are fully magnetized in the positive z direction; see FIG. 3*c*. The two circled reference signs 1 represent the respective flux densities in the magnet.

Figure 6:
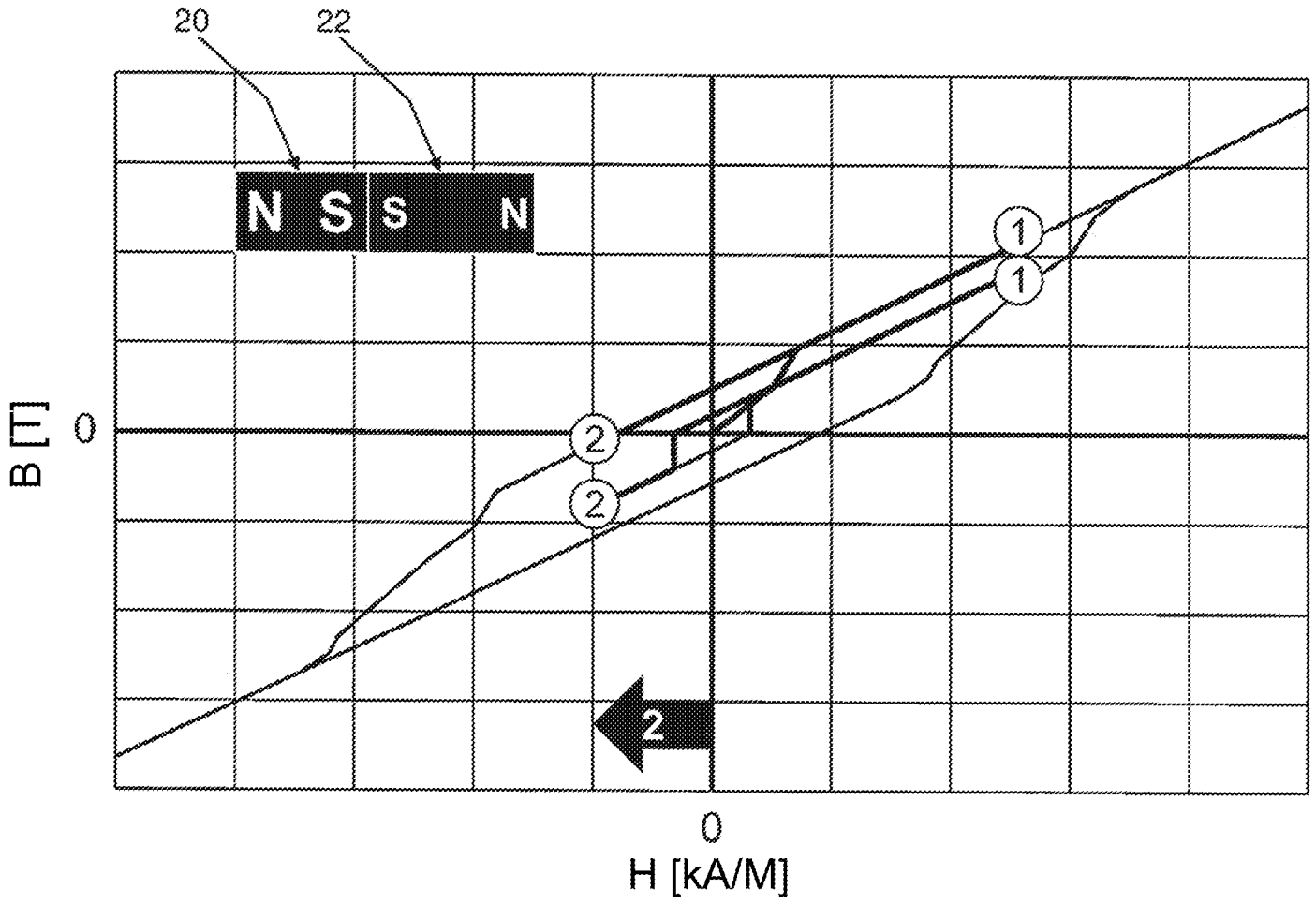
FIG. 6 shows the magnetization of the two magnets having a second magnetic field having a predetermined field strength in a second magnetic field direction opposite to the first magnetic field direction on the basis of the magnetization curves shown in FIG. 4.
Figure 7:
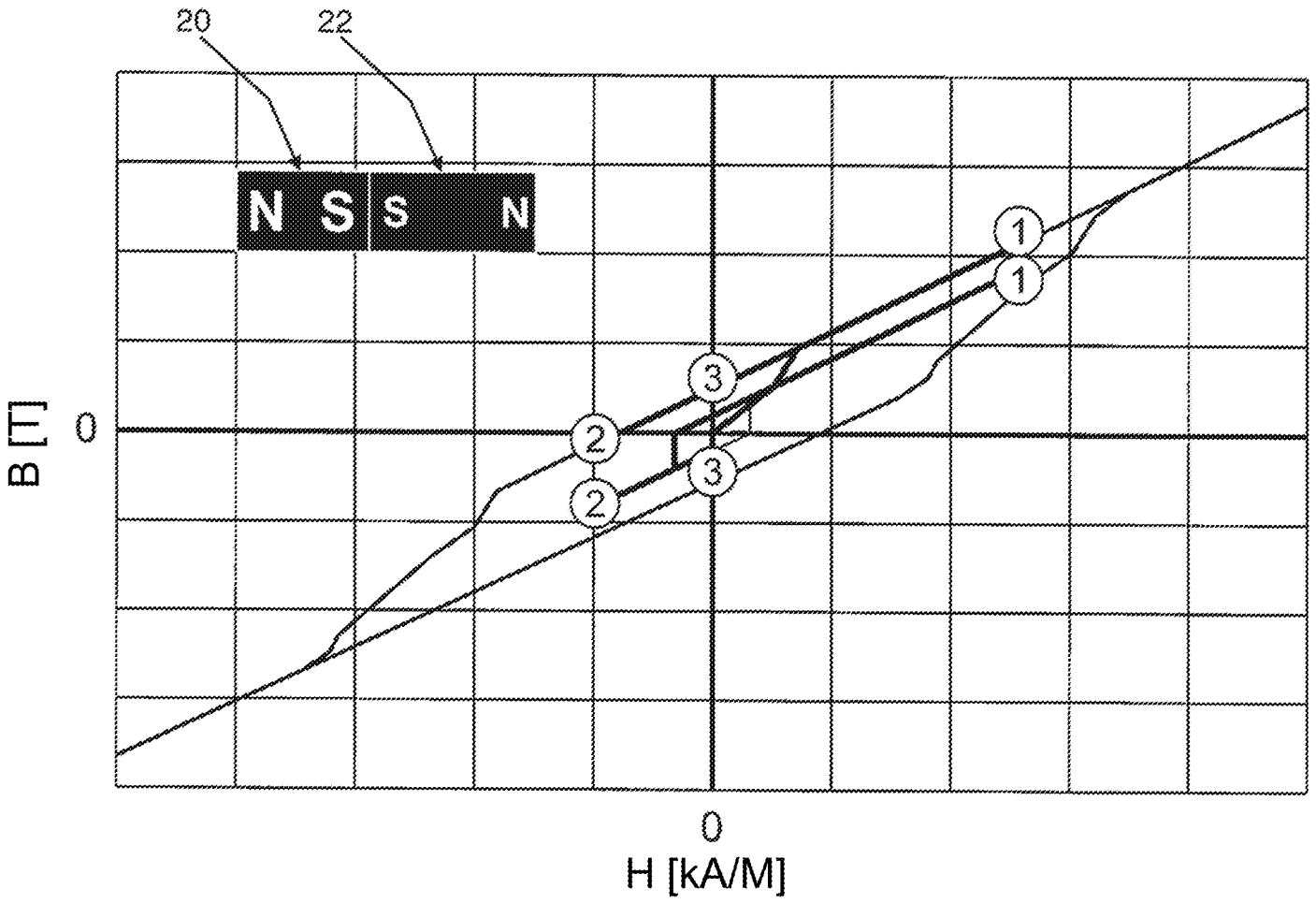
FIG. 7 shows the magnetization state of the two magnets after removing the second magnetic field on the basis of the magnetization curves shown in FIG. 4.

FIGS. 6 and 7 will now be considered. It is assumed that the first excitation current is switched off and a predeterminable second excitation current, which is lower than the first excitation current, is fed into the magnetization coil 60 in the opposite direction, which causes a second substantially homogeneous magnetic field having a predeterminable field strength in a second magnetic field direction opposite the first magnetic field direction, for example in the negative z direction, in the interior 62 of the magnetization coil 60, as symbolized by the arrow pointing to the left in FIG. 6. In this way, the two magnets 20 and 22 are simultaneously exposed to the second magnetic field in the negative z direction such that the magnets 20 and 22 each have a different magnetization. The first and second excitation currents are preferably direct currents that flow through the magnetizing coil 60 in a pulsed manner for an adjustable time.

It can be seen from FIGS. 5 to 7 that the field strength of the second magnetic field is lower than the field strength of the first magnetic field. In particular, the field strength of the second magnetic field is selected such that the magnetization of the magnet 22 having a lower coercivity is reversed, whereas the magnetization of the magnet 20 having a higher coercivity is not weakened. The magnetization state of the two magnets 20 and 22 after the second magnetization is indicated in FIGS. 6 and 7 by the two circled reference signs 2. The different magnetization levels at the points labeled as 2 are achieved in that the internal magnetic field of the magnet 20 having a higher magnetic coercivity does not yet allow any flux in the opposite direction, i.e. the field direction of the second magnetic field (z direction according to FIG. 3*c*), which could result in weakening of the magnet 20. By contrast, the internal magnetic field strength of the magnet 22 having a lower magnetic coercivity is lower than that of the first magnet, such that a magnetic flux is produced in the magnet 22 in the opposite direction, i.e. in the z direction, which weakens the magnet 22 and ultimately also reverses the polarity of said magnet at the selected field strength of the second magnetic field. The magnetization state of the two magnets 20 and 22 after switching off the second excitation current or after removing the assembly 10 from the magnetization coil 60 is shown in FIG. 7 by the two circled reference signs 3. As a result, the magnet 20 is fully magnetized in the z direction, while the magnet 22 is fully magnetized in the negative z direction. This is shown in FIG. 7 by the two schematically shown magnets 20 and 22 and the respectively indicated north and south poles.

An assembly having the properties of a three-pole magnet then results from the two magnets 20 and 22 which were previously unmagnetized or premagnetized as desired, namely an assembly having two outer north poles and a common inner south pole.

The invention claimed is:

1. A method for magnetizing at least two magnets having different magnetic coercivities, the method comprising the steps of:

a) simultaneously exposing the at least two magnets to a first substantially homogeneous magnetic field having a predeterminable first field strength and a first magnetic field direction for completely magnetizing the magnets in the first magnetic field direction;

b) simultaneously exposing the magnets magnetized in step a) to a second substantially homogeneous magnetic field having a predeterminable second field strength and a second magnetic field direction opposite to the first magnetic field direction such that the at least two magnets are differently magnetized, the first field strength being higher than the second field strength.

2. The method according to claim 1, wherein:

before carrying out steps a) and b), further comprising the step of arranging the at least two magnets in a magnetization device, the first and second magnetic fields being provided by the magnetization device.

3. The method according to claim 1, further comprising the step of:

arranging the at least two magnets one behind the other relative to the first and second magnetic field directions.

4. The method according to claim 1, wherein:

in step b), the predeterminable second field strength of the second magnetic field is set such that the at least two magnets are magnetized in opposite directions, the magnet having the higher magnetic coercivity being magnetized in the first magnetic field direction and the magnet having the lower coercivity being magnetized in the second magnetic field direction.

5. The method according to claim 1, further comprising the step of:

unmagnetizing or premagnetizing the at least two magnets before carrying out steps a) and b).

6. The method according to claim 2, wherein:

the at least two magnets are arranged one behind the other relative to the first and second magnetic field directions.

7. The method according to claim 2, wherein:

in step b), the predeterminable second field strength of the second magnetic field is set such that the at least two magnets are magnetized in opposite directions, the magnet having the higher magnetic coercivity being magnetized in the first magnetic field direction and the magnet having the lower coercivity being magnetized in the second magnetic field direction.

8. The method according to claim 3, wherein:

in step b), the predeterminable second field strength of the second magnetic field is set such that the at least two magnets are magnetized in opposite directions, the magnet having the higher magnetic coercivity being magnetized in the first magnetic field direction and the magnet having the lower coercivity being magnetized in the second magnetic field direction.

9. The method according to claim 2, further comprising the step of:

unmagnetizing or premagnetizing the at least two magnets before carrying out steps a) and b).

10. The method according to claim 3, further comprising the step of:

unmagnetizing or premagnetizing the at least two magnets before carrying out steps a) and b).

11. The method according to claim 4, further comprising the step of:

unmagnetizing or premagnetizing the at least two magnets before carrying out steps a) and b).

* * * * *